United States Patent [19]

Castricum

[11] Patent Number: 4,711,110

[45] Date of Patent: Dec. 8, 1987

[54] APPARATUS FOR CRIMPING PIPE

[75] Inventor: Wilhelmus P. H. Castricum, Rolling Meadows, Ill.

[73] Assignee: Spiro America Inc., Wheeling, Ill.

[21] Appl. No.: 922,749

[22] Filed: Oct. 24, 1986

[51] Int. Cl.[4] ..... B21D 19/04

[52] U.S. Cl. ..... 72/49; 72/70; 72/84; 72/105

[58] Field of Search ..... 72/48, 49, 50, 101, 72/105, 96, 95, 84, 72, 70, 68

[56] References Cited

U.S. PATENT DOCUMENTS

| | | | |
|---|---|---|---|
| 3,132,616 | 5/1964 | Hale . | |
| 3,662,579 | 5/1972 | Lewis | 72/105 |
| 3,940,962 | 3/1976 | Davis . | |
| 4,018,072 | 4/1977 | Davis . | |
| 4,041,747 | 8/1977 | Elkin | 72/105 |
| 4,567,742 | 2/1986 | Castricum . | |

OTHER PUBLICATIONS

The Spiro Edgeformer 1231 S Brochure (undated).

*Primary Examiner*—Lowell A. Larson
*Attorney, Agent, or Firm*—Willian Brinks Olds Hofer Gilson & Lione Ltd.

[57] ABSTRACT

An apparatus for crimping the leading edge of continuously produced spiral pipes is disclosed. The apparatus includes upper and lower passive crimping rollers, which are rotatably mounted adjacent each other in a holder. The holder is carried by a guide rail system which slides in the axial direction of the spirally moving pipe. The holder and rollers are rotated between a down position, where the continuously produced pipe will move freely over the crimping apparatus, and an up position where the leading edge of the pipe will pass between the upper and lower crimping rollers. When the crimping apparatus is in the up position and the leading edge of the pipe is between the crimping rollers, the lower roller is raised until the rollers cooperate to crimp the leading edge of the pipe. The spirally moving pipe will exert a force on these rollers, which causes the guide means, which carries the rollers, to move axially with the pipe. The crimping rollers will crimp the entire circumference of the pipe's leading edge as the crimping rollers move axially with the pipe and the leading edge of the pipe rotates between the rollers. When the entire leading edge of the pipe has been crimped, the holder and rollers are rotated to their down position, so that the pipe production can resume without obstruction by the crimping apparatus.

20 Claims, 18 Drawing Figures

8.
4a.
4b.
216
217
216-h
217-h
216-ℓ
217-ℓ
228-b
332
333
316
317
318
323
324
325
344-f
345-f
346
348
349-f
349-b
344-b
345-b
350
351
352
353
354
359
362
363
365
367
370
371
372
375
376
378
382
383
385
386
388
389
390
391
392
393
310
311
312
313

APPARATUS FOR CRIMPING PIPE

BACKGROUND OF THE INVENTION

This invention generally relates to an apparatus for crimping pipes. The preferred embodiment of the invention particularly relates to an apparatus for crimping the leading edge of continuously produced, spirally formed pipe.

Lightweight metal pipes are widely used for ventilation ducts. U.S. Pat. Nos. 4,567,742 (Castricum) and 3,132,616 (Hale) disclose two types of machine for continuously producing spirally formed metal pipes. Each machine uses a continuous, flat strip of metal as a starting material. A drive means feeds the metal strip into and through the pipe forming machine. The strip first passes through a series of metal forming rollers which bend the outer edges of the strip into predetermined shapes. Next, the metal strip passes around a forming head or mandrel in a spiral manner, so that strip forms a spiral-shaped cylinder with the outer edges of the strip adjacent each other. The adjacent edges of the strip are then compressed to form a metal pipe having a spiral or helical lockseam.

The spiral (helical) pipe is formed continuously in this manner as long as the metal strip is fed through the machine. It should be understood that during the pipe forming process the pipe and its leading edge move spirally, that is, they rotate and move forward in the axial direction of the pipe at the same time. The trailing edge of the pipe being formed remains in the forming head of the machine.

It should also be apparent that this type of spiral pipe forming machine can make pipe of any desired length. When the continuously formed pipe reaches its desired length, it is severed. A preferred apparatus for cutting spiral pipe is disclosed in my co-pending U.S. patent application, Ser. No. 876,286, filed June 15, 1986, which is a continuation-in-part of application Ser. No. 746,237, filed June 18, 1985, now abandoned. This preferred pipe cutting apparatus cuts a section of pipe with minimal interruption to the pipe forming process.

Frequently, a plurality of pipe sections must be joined together to extend across a long expanse. One method of joining pipe sections is to crimp the circumferential edge at one end of a pipe section. The crimped edge will have a series of corrugations around its circumference, which will be slightly smaller in diameter than the uncrimped part of the pipe section. The crimped end of one pipe section should fit snugly into an uncrimped opening of another pipe section. In this manner a plurality of similarly shaped pipe sections, each having a crimped end and an uncrimped end, can be easily connected together in series.

The assignee of the present invention presently uses a pipe crimping machine that is separate from, and operates independently of, the pipe forming machine. This crimping machine has an upper crimping roller and a lower crimping roller mounted adjacent each other. Each roller has a plurality of teeth spaced around its circumference, so that each roller looks like a gear. The lower roller can be moved towards or away from the upper roller. When the rollers are apart, one end of a pipe section is inserted between the rollers. The lower roller is then moved towards the upper roller until the teeth of the two rollers crimp and grip the pipe. One of the rollers is then mechanically driven, so that it rotates the pipe between the two rollers and the entire circumference of the pipe is crimped. The rollers are then separated and the pipe section removed from the crimping machine.

While this type of crimping machine serves its intended purpose of crimping the end of a pipe section, it has some disadvantages. Primarily, this type of crimping machine requires manual operation. Someone must physically take each section of cut pipe from a discharge rack adjacent the cutting machine, carry it to the crimping machine, crimp one end of the pipe, and then store the crimped pipe at another location. These manual steps become increasingly difficult as the length of the pipe section increases.

Thus, when pipe sections become rather long, for example, 20 feet, alternatives to crimping may be used to connect pipe sections. One such alternative is a separate connector piece. The connector may be a short section of pipe (approximately four inches long) having a diameter that is slightly smaller than the diameter of the uncrimped ends of the pipes sections to be joined. A raised circumferential bead is provided near the middle of the connector. The outer diameter of the bead is slightly greater than the diameter of the pipe sections. Thus, adjacent pipe sections are slid over opposite ends of the connector until they abut the central bead. Screws or other fastening means are used to secure both pipe sections to the underlying connector.

This type of connector also has its disadvantages. For example, it requires the manufacture of an additional part—the connector. Additional labor is required for drilling holes in the pipe sections and connector for the screws, and for fastening the screws. Having an exposed connector in both pipe sections will also provide an interruption or obstacle to the flow of fluid through the pipe, regardless of the direction of the fluid flow.

SUMMARY OF THE INVENTION

The present invention is directed to an apparatus for crimping the leading edge of a continuously produced pipe, where the pipe rotates and moves forward in its axial direction during production. In the preferred embodiment this crimping apparatus is intended to work in conjunction with a continuous spiral pipe forming machine.

The crimping apparatus itself includes first and second rollers, which each have a corrugated circumferential edge. The rollers are rotatably mounted adjacent each other in a holder means. The holder means and rollers are carried by a guide means, which is slidable in the axial direction of the pipe. A means is provided for moving the holder means and rollers between a first position, where the continuously produced pipe can move freely by the holder means and rollers, and a second position where the leading edge of the pipe will pass between the rollers. A lifting means raises the first roller towards the second roller when the holder means is in the second position and the leading edge of the pipe is between the rollers, so that the corrugated edges of the rollers cooperate to crimp the pipe's leading edge. The guide means, which carries the holder means and rollers, will slide in the axial direction of the pipe as it moves forward, and the corrugated edges of the roller will crimp the circumference of the leading edge of the pipe as it rotates between the rollers.

The preferred embodiment of the present invention includes several other important elements. For example, the holder means includes a first section in which the first roller is mounted, and a second section in which the second roller is mounted. The second section is pivotally connected to the first section, so that when the pipe's lockseam rotates between the rollers, the second roller will move away from the first roller and the rollers cooperate to crimp part of the pipe's leading edge adjacent to the lockseam.

Other features of the preferred embodiment of the invention are discussed in the following detailed description.

The crimping apparatus of the present invention is particularly designed for use with a machine that continuously produces spiral pipe. After one pipe section has been formed and severed, the crimping apparatus can automatically crimp the leading edge of the next pipe section to be formed. The crimping apparatus will move axially with the pipe exiting the forming machine and crimp the pipe's leading edge as it rotates between the crimping rollers. In this manner, the pipe's leading edge can be rectangularly crimped without removing the pipe from its forming machine. When the crimping is completed and the pipe continues to be formed to its desired length, the crimping apparatus is moved to a position where it does not interfere with the pipe forming process.

The crimping apparatus of the present invention thus overcomes many of the disadvantages associated with present crimping machines or other types of pipe section connectors as discussed above. Indeed, a specific object of the present invention is to provide a crimping apparatus that will crimp the leading edge of continuously produced spiral pipe with minimal interruption of the pipe forming process.

The invention itself, together with further objects and attendant advantages, will best be understood by reference to the following detailed description taken in conjunction with the drawings.

BRIEF DESCRIPTION OF THE DRAWINGS

FIG. 11 illustrates the leading edge of a spiral pipe which has been crimped with the crimping apparatus of the present invention.

FIG. 12 is a sectional view taken along lines 12—12 of FIG. 11.

DETAILED DESCRIPTION OF A PREFERRED EMBODIMENT

Figure 1:
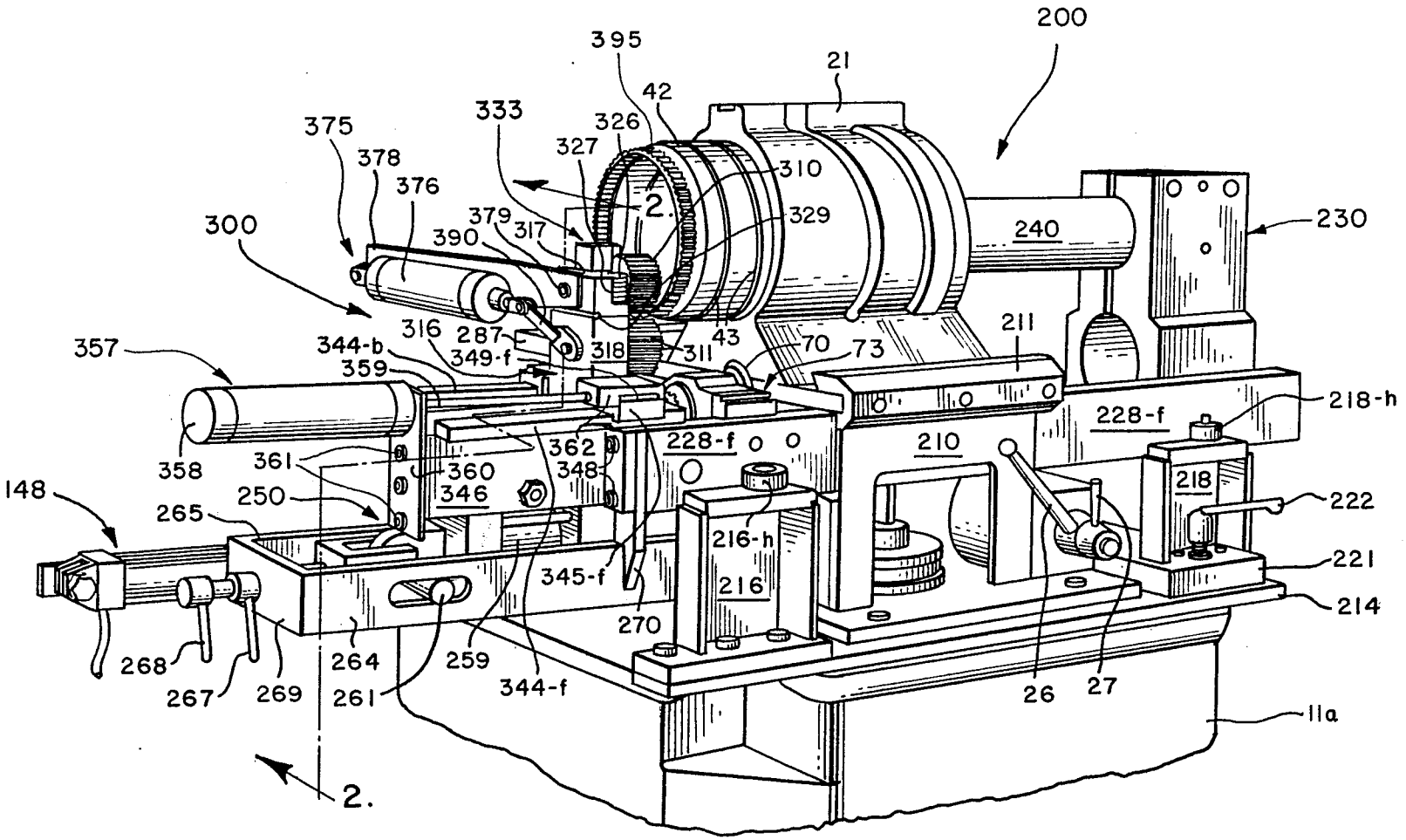
FIG. 1 is a perspective view of the preferred embodiment of the crimping apparatus of the present invention in position, and a pipe cutting apparatus.

Referring now to the drawings, FIG. 1 shows the preferred crimping assembly 300 being used in conjunction with the pipe cutting apparatus 200. The pipe cutting apparatus 200 is described in detail in my co-pending patent application Ser. No. 876,286, filed June 17, 1986. The elements of the pipe cutting apparatus (or slitter assembly) 200 which are shown in FIGS. 1–8*c* of the present application use the same names and reference numbers given to them in the patent application Ser. No. 876,286. All the figures and the entire disclosure of patent application Ser. No. 876,286 are incorporated by reference herein and made a part hereof.

Figure 2:
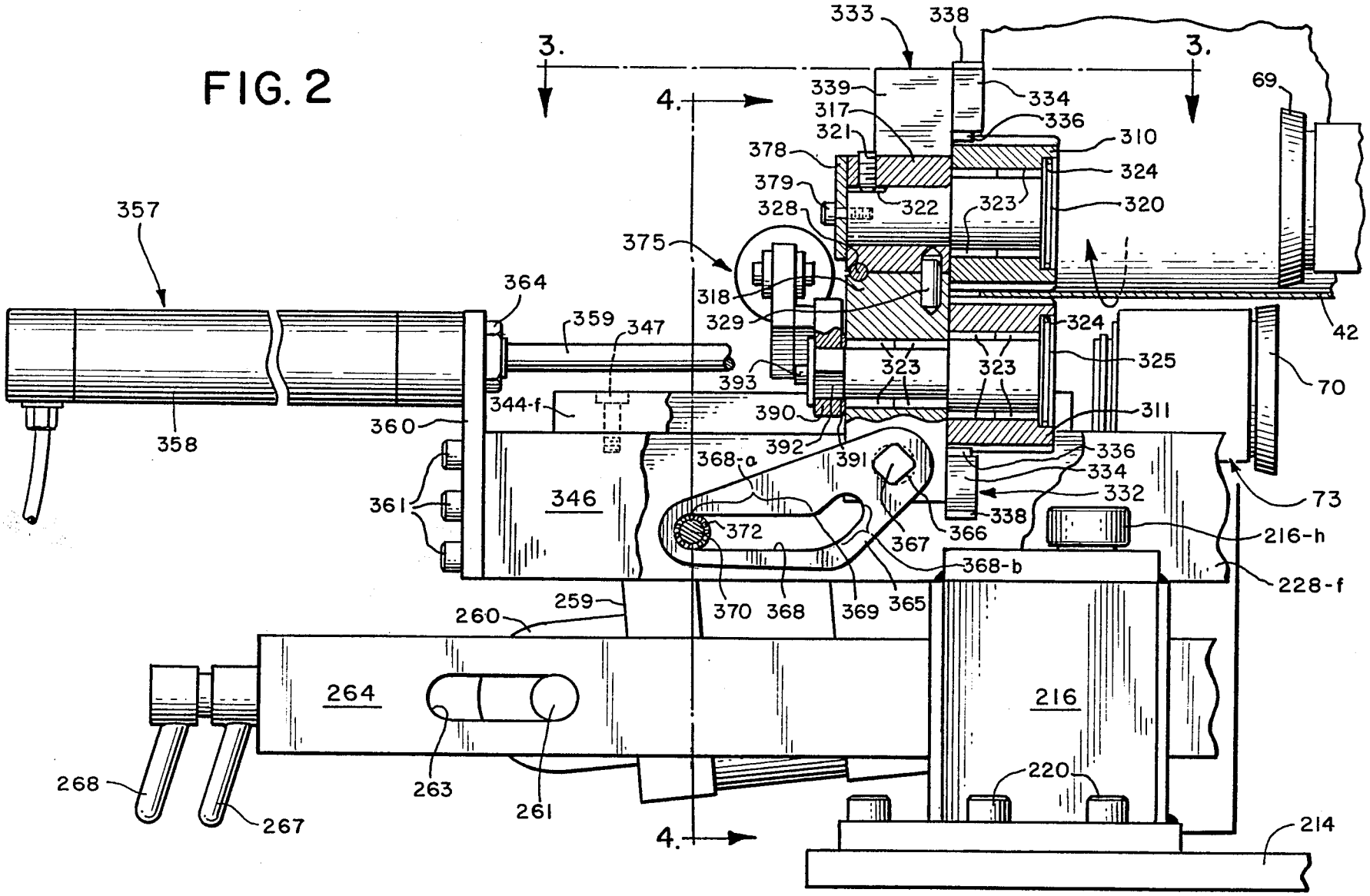
FIG. 2 is a side view, partially in elevation and partially in section taken along lines 2—2 of FIG. 1.
Figure 9:
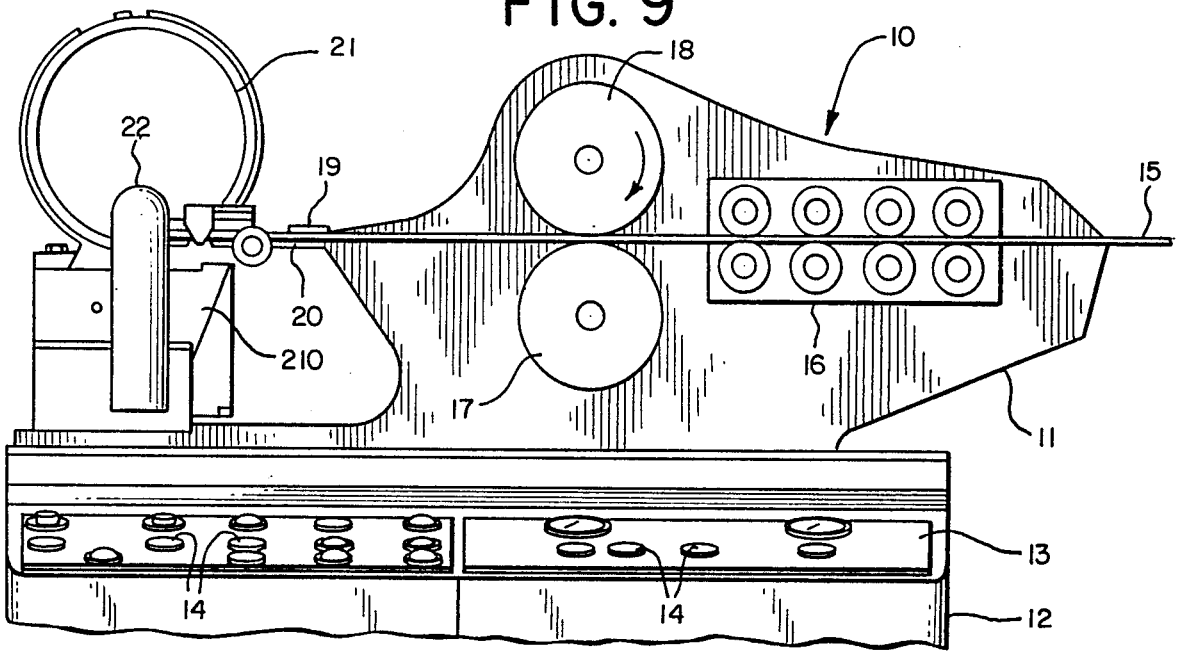
FIG. 9 is a side elevational view of a spiral pipe producing machine with which the preferred embodiment of the present invention can be used.
Figure 10:
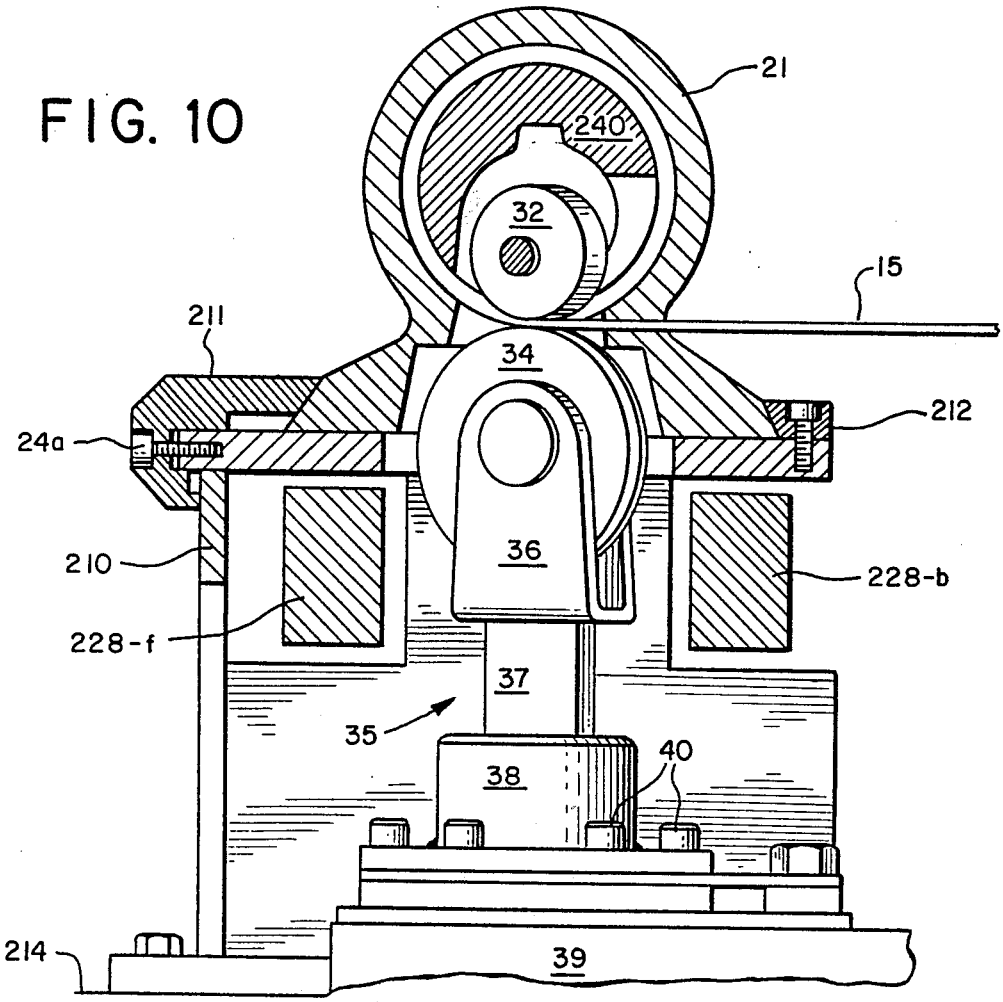
FIG. 10 is a sectional view of a spiral pipe producing machine and slitter assembly with which the preferred embodiment of the present invention can be used.

Crimping assembly 300 and slitter assembly 200 are preferably used in conjunction with a machine which continuously produces spiral seamed pipe from a continuous strip of metal. My patent application Ser. No. 746,237, filed June 18, 1985, the parent of my patent application Ser. No. 876,286, includes a brief description of a spiral pipe forming machine. (See FIGS. 1–3). FIGS. 2 and 19 of my application Ser. No. 846,286, are reproduced herein as FIGS. 9 and 10. The spiral pipe forming machine shown in FIGS. 9 and 10 will be briefly described here. A more detailed description of this type of spiral pipe forming machine is disclosed in my U.S. Pat. No. 4,567,742, which is incorporated by reference herein and made a part hereof.

The spiral pipe producing machine 10 includes a frame 11 and a control cabinet 12. A plurality of control knobs, gauges, and dials 14 are located on the control panel 13 for controlling and monitoring the operation of the machine 10 and the slitter assembly 200. The functions of the various control switches are described in detail in my application Ser. No. 746,237.

A roller housing 16 is mounted in the frame 11. The roller housing contains a plurality of rollers which bend the edges of the metal strip 15 in predetermined shapes for forming a lockseam, and which may form corrugation grooves and stiffening ribs in the metal strip. It should be understood, however, that it may be difficult to crimp the end of a ribbed pipe with the crimping apparatus of the present invention. An upper drive roller 18 and a lower drive roller 17 are rotatably mounted within the frame 11 adjacent the roller housing 16. The upper drive roller 18 pulls the continuous metal strip 15 into the frame 11, through the roller housing 16, and over the lower drive roller 17. The drive rollers then cooperate to push the metal strip 15 between the upper guide plates 19 and the lower guide plates 20 into the forming head 21.

The forming head 21 curls the metal strip in a helical manner so that the outer pre-formed edges of the strip 15 are adjacent each other and mesh. The helically curled strip thus takes the shape of a spiral cylinder. The adjacent, mated edges of the strip are then compressed between a support roller 32 and a clinching roller 34 to form a lockseam 43. The metal strip 15 is continuously pushed by the drive rollers 17, 18 through the forming head 21 and between the clinching roller 34 and support roller 32, in a spiral manner, so that a spiral pipe 42 is continuously produced with a spiral lockseam 43.

The support roller 32 is mounted on the upper guide plate 19. A support arm 22 pushes down on the support roller 32 and holds it in place. The clinching roller 34 is moved into and out of its clinching position by a conventional hydraulic cylinder assembly 35, which operates in a known manner. The cylinder assembly 35 includes a yoke 36 which holds the clinching roller 34. The yoke is appended to a piston rod 37, which slides in and out of the cylinder head 38. The cylinder head 38 is attached to the cylinder barrel 39 by bolts 40. The hydraulic cylinder assembly 35 provides the pressure on the clinching roller 34 to close the lockseam 43.

The forming head 21 is secured to the forming head base 210 by the clamping bar 211 and bolts 24*a*. The clamping bar 211 allows the forming head 21 to be easily removed. Different size forming heads can be used with the same spiral pipe producing machine 10 to produce spiral pipe of various diameters.

It should be understood that as the spiral pipe is formed, it will move out of the forming head 21 in a spiral manner. That is, the pipe 42 and its leading edge will simultaneously rotate and move forward in the axial direction of the pipe. The pipe 42 will be continuously produced until it reaches its desired length. At that point the slitter assembly 200 will sever the pipe into a section in the manner described in my patent application Ser. No. 876,286.

The crimping apparatus 300 is generally designed to crimp the leading edge of the pipe 42 before it is formed to its desired length and cut into a section. Thus, when the pipe is cut into a section by the slitter assembly 200, its leading edge is already crimped. (See FIG. 1) The crimping process is thus made integral with the continuous spiral pipe production process. Details of the structure and operation of the crimper assembly 300 will now be described.

The crimping apparatus 300 includes an upper crimping roller 310 and a lower crimping roller 311. Each crimping roller contains twenty-six teeth 312 evenly spaced around its circumferential edge. Between each pair of adjacent teeth is a groove 313. These teeth 312 (and grooves 313) provide each roller 310, 311 with a corrugated circumferential edge. Gear rollers are presently acquired from Reinhardtmashinenbau GmbH, Richard Wagner Strasse 4-10, 738 Sindelfingen, West Germany (part no. 021273), for use as crimping rollers 310 and 311.

Figure 8:
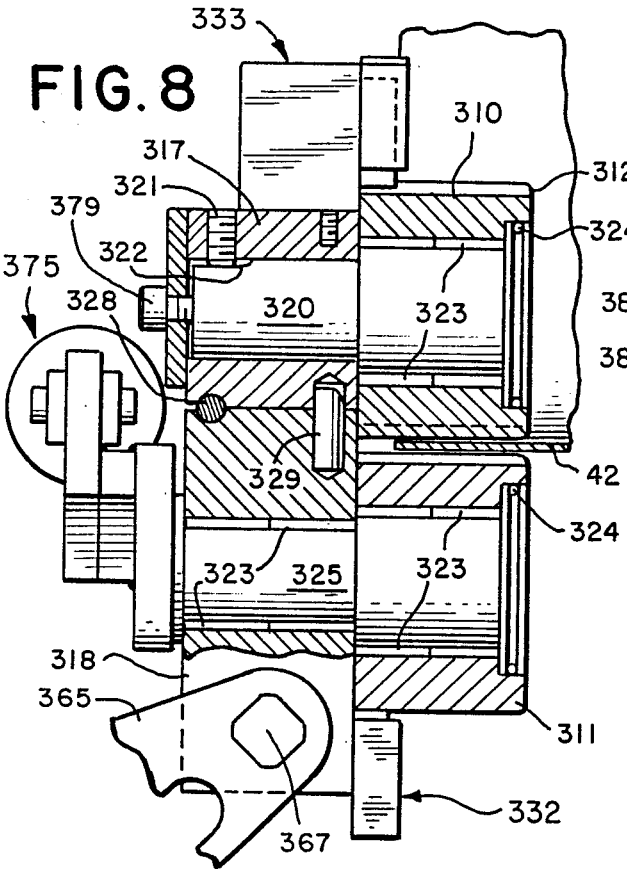
FIG. 8 is a sectional view taken along lines 8—8 of FIG. 4.
Figure 8A:
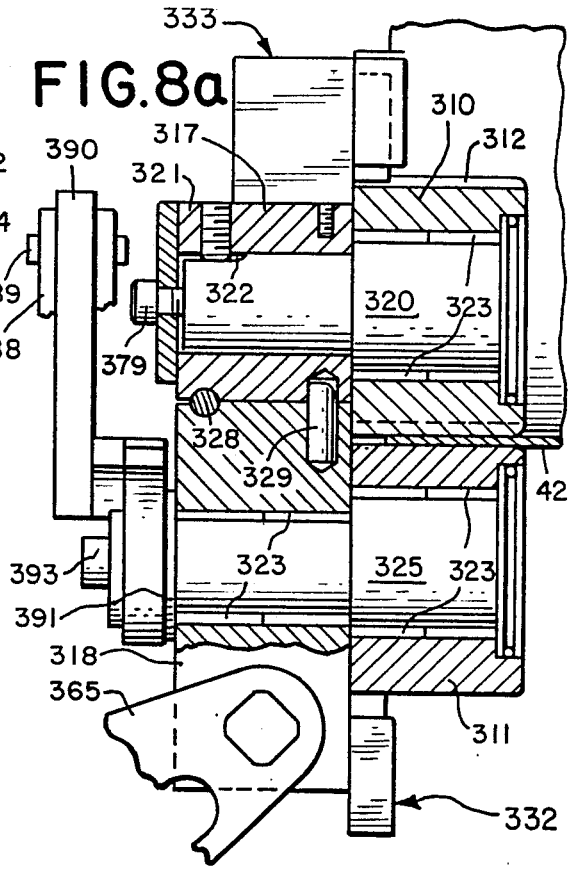
FIG. 8*a* is a sectional view showing the lower crimping roller of FIG. 8 is a raised position.
Figure 8B:
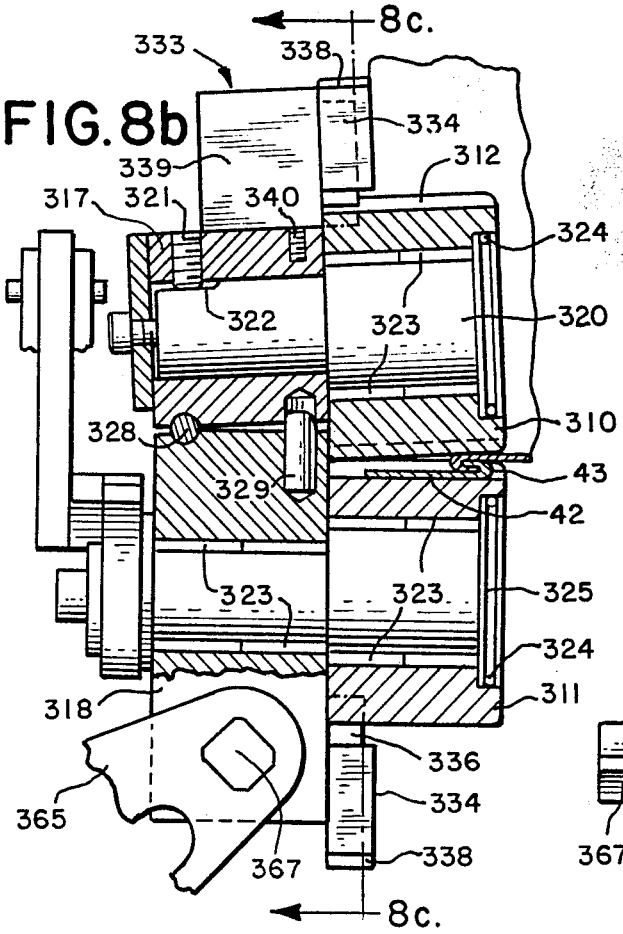
FIG. 8*b* is a sectional view showing the upper crimping roller of FIG. 8*a* pivoted away from the lower crimping roller.
Figure 8C:
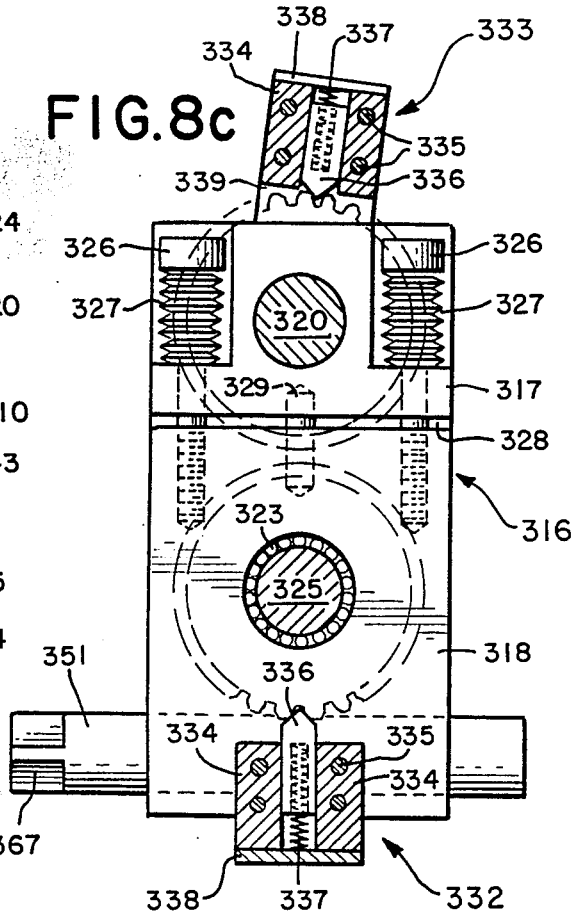
FIG. 8*c* is a sectional view taken along lines 8*c*—8*c* of FIG. 8*b*.

The crimping rollers 310 and 311 are rotatably mounted adjacent each other in a holder assembly 316. As best shown in FIGS. 8—8*c*, the holder assembly 316 includes an upper section 317 and a lower section 318. The upper roller 310 is mounted around an upper shaft 320, which is secured into a cavity in the upper holder section 317 with a recessed allen bolt 321. The upper shaft 320 is provided with a flat surface 322 which is engaged by the bolt 321. The bolt 321 engages the flat surface 322 to prevent the upper shaft 320 from rotating. Needle bearings 323 are placed between the inner diameter of the upper roller 310 and the part of the upper shaft that extends outside of the upper section 317 to allow the upper roller 310 to be passively rotatable. By passive rotation, I mean that the roller will rotate in response to an external torque; the roller is not actively driven, with a motor, for example. All needle bearings used in the crimper assembly 300 are presently purchased from IKO Bearings, Arlington Heights, Ill. Needle bearings 323 are packed in grease. An O-ring 324 is provided to seal in the grease.

The lower crimping roller 311 is mounted around an eccentric lower shaft 325, which is located in a cavity in the lower holder section 318. Needle bearings 323 are placed between the inner diameter of the lower roller 311 and the part of the lower eccentric shaft 325 that extends outside of the front face of the lower section 318 to allow the lower roller 311 to be passively rotatable. Needle bearings 323 are also placed around the part of the lower eccentric shaft 325 within the lower holder section 318, so that the eccentric shaft 325 may be rotated as will be described below. An O-ring 324 is also provided for the lower shaft 325 to seal in grease packed around its associated needle bearings 323.

The upper holder section 317 is pivotally connected to the lower holder section 318 in the following manner. The front of the upper section 317 is joined to the front of the lower section with two bolts 326. These bolts are threaded only into the lower section 318, and not into the upper section 317. A conventional spring washer 327 is located between the head of each bolt 326 and the upper section 317. The bolts 326 can be turned to adjust the pressure on the spring washers 327. A pivot rod 328 is placed in grooves at the back ends of the upper and lower sections. A pin 329 is provided in complementary vertical bores in the upper and lower sections 317, 318 to prevent these sections from shifting laterally with respect to each other.

These elements of roller holder assembly 316 cooperate to allow the upper holder section 317 and upper roller 310 to pivot away from the lower holder section 318 and lower roller 311 when the pipe lockseam 43 rotates between the rollers during the crimping process. (See FIG. 8*b*) The lockseam 43 is comprised of four layers of the metal strip 15, whereas the rest of the pipe is only one layer thick. The upper roller 310 must be allowed to move up and over the lockseam as it passes between the crimping rollers. Otherwise, a roller shaft will break, the pipe producing machine will stall, or something else will give.

The pivotal connection between the upper and lower holder sections also allows the rollers 310, 311 to still crimp the part of the pipe 42 located between the lockseam 43 and the leading edge of the pipe. Since the upper roller 310 pivots backwards and the spring washers 327 exert a constant downward force on the upper section 317, the upper roller teeth still cooperate with the lower roller teeth to crimp the lockseam 43 and that part of the leading edge of the pipe to the left of the lockseam 43, as shown in FIG. 8*c*.

A lower index unit 332 and an upper index unit 333 are provided to offset the teeth 312 of the upper roller 310 with respect to the teeth 312 of the lower roller 311 by the angular displacement of one-half tooth. (See FIG. 6, for example.) In other words, the index units 332, 333 assure that the teeth 312 of the upper roller 310 are always aligned with the grooves 313 of the lower roller 311, and vice versa. The corrugated edges of the rollers 310, 311 must overlap in this manner in order for the rollers to crimp the leading edge of the pipe 42. In other words, the teeth 312 on the upper and lower rollers 310, 311 should not be aligned.

The lower index unit 332 includes a U-shaped container 334 which is secured to the front face of the lower holder section 318 with recessed allen bolts 335. A hollow pointed peg 336 slides within the cavity formed by the U-shaped container 334 and the front face of the lower section 318. A spring 337 is held within the hollow cavity of the peg 336 by a plate 338, which is attached to the top of the container 334 with bolts 341. The spring 337 forces the point of the peg 336 into a groove 313 of the lower roller 311 to prevent the roller from rotating idly, and to maintain the lower roller teeth in a fixed orientation relative to the upper roller teeth. The spring 337 also allows the peg 336 to withdraw from a groove 313 as the roller is rotated by an external force. It can be seen that the peg 336 will engage each successive groove of the roller as the roller rotates. The container block 334 is positioned on the lower holder section 318 so that the peg 336 engages a groove which is in the vertical centerline of the holder assembly 316 and rollers 310, 311.

The upper index unit 333 includes the same elements of the lower index unit 332, but these elements are attached to the front face of a square mounting block 339. The mounting block 339 is secured to the top of the upper holder section 317 with a plurality of recessed allen bolts 340. The bottom surface of the mounting block 339 is cut at a seven degree angle, which corresponds to the angular displacement of one-half of a tooth 312. (The 360 degree roller circumference divided by 26 teeth per roller yields an approximate 14 degree angular displacement per tooth. Thus, 7 degrees represents the approximate angular displacement of one-half tooth.) Thus, the peg 336 on the upper index unit 333 will engage a groove 313 on the upper roller 310 that is offset seven degrees from the centerline of the holder assembly 316 and rollers 310, 311. The upper index unit 333 thereby cooperates with the lower index unit 332 to offset the teeth of the upper and lower rollers 310, 311 one-half tooth with respect to each other.

A slidable guide system is provided for carrying the holder assembly 316 and its attached rollers 310, 311. The guide system preferably includes two THK type SR 25S slide systems, sold by THK America, Inc, Elk Grove Village, Ill. Each slide system includes a slide rail 344 and slide block 345. A front slide rail **344-*f* is secured to the top of the front linear guide rail 228-*f* of the slitter assembly 200 and to the top of an extension bracket 346 with recessed allen bolts 347. Only part of the back slide rail 344-*b* is attached to the back linear guide beam 228-*b* with two recessed allen bolts 347. The left side of the back slide rail 344-*b* hangs off the left end of the back guide beam 228-*b*. The back slide rail 344-*b* and back slide block 345-*b* should not interfere with the back, left upper guide beam roller 217-*u*. (The suffixes "b" and "f" are used to denote identical elements which are located at the back or front side of the machine, respectively. For purposes of orientation, the front side of the crimper assembly will be that side shown in FIG. 2. The left end of the crimper assembly will be the end shown in FIG. 4**.)

The extension bracket 346 is fastened to the flange 270 of the slitter assembly 200 and to the left end of the front linear guide beam **228-*f* with threaded bolts 348. It should be appreciated that the extension bracket 346 is designed to fit over the flange 270 and to use the same threaded holes in the front guide beam 228-*f* as the flange 270. The extension bracket 346 is needed to support the hydraulic cylinder assembly 357. Thus, only one extension bracket 346 is required at the front of the crimper assembly 300. A second such extension bracket is not needed to support the back slide rail 344-*b***, as the holder and other parts supported by the slide rails are not that heavy.

Figures 4, 4A, 4B, 4C:
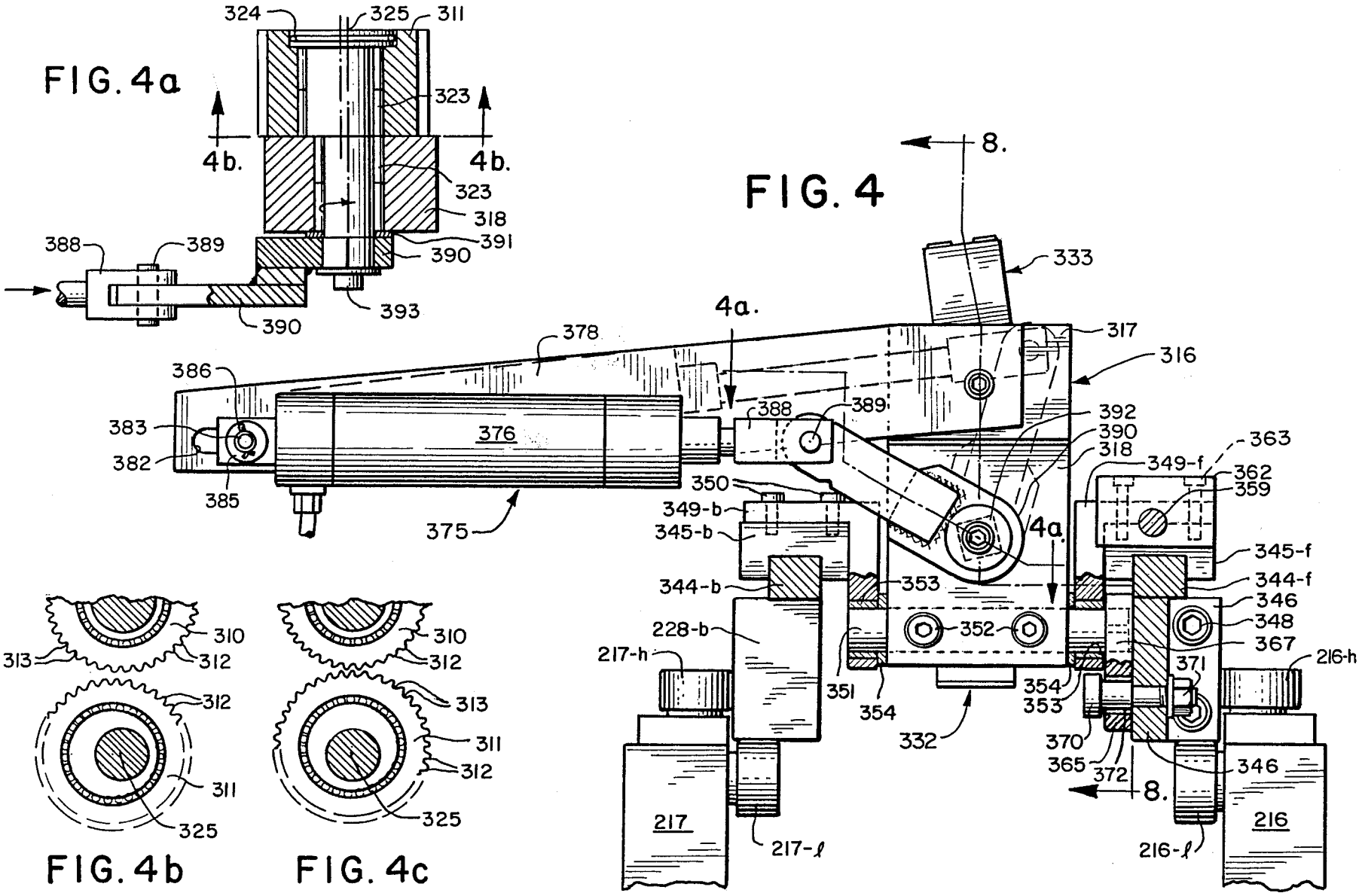
FIG. 4 is a left end view, partially in elevation and partially in section, taken along lines 4—4 of FIG. 2.
FIG. 4*a* is a sectional view taken along lines 4*a*—4*a* of FIG. 4.
FIG. 4*b* is a sectional view taken along lines 4*b*—4*b* of FIG. 4*a*.
FIG. 4*c* is a sectional view showing the lower crimping roller of FIG. 4*b* in a raised position.

The front slide block **345-*f* and back slide block 345-*b* are designed to slide back and forth along the front and back slide rails, respectively. Referring to FIG. 4, a front swivel bracket 349-*f* and back swivel bracket 349-*b* are fixed to the tops of the front and back slide blocks, respectively. Two allen bolts 350 fix the back swivel bracket 349-*b* to the back slide block 345-*b*. A swivel shaft 351 passes through a transverse bore in the lower holder section 318 and a circular opening in each swivel bracket 349. The part of the swivel shaft 351 passing through the lower holder section 318 contains a flat surface which is engaged by allen bolts 352. The allen bolts 352 secure the holder assembly 316 to the swivel shaft 351, so that the holder assembly 316 will move linearly and will rotate together with the swivel shaft 351. Needle bearings 353 allow the swivel shaft 351, and the holder assembly 316 and other parts fixed to it, to rotate relative to the swivel brackets 349. A distance ring 354 is placed between both swivel brackets 349 and the lower holder section 318 to reduce friction by preventing the lower holder section 318 from rubbing the swivel brackets 349. It is presently contemplated that some type of tie bar, or equivalent means, be connected between the front and back swivel brackets 349 or front and back slide blocks 345 to prevent any lateral twisting of the crimper assembly 300. One such tie bar could be U-shaped and connected to the bottom surfaces of the swivel brackets 349**.

A first pneumatic cylinder assembly 357 is provided to move the front slide block **345-*f* back and forth along the front slide rail 344-*f*. (See FIG. 1) Of course, the parts connected to the front slide block 345-*f* will move with it. The first pneumatic cylinder assembly includes a cylinder body 358 and a ram 359 which can be actuated linearly in and out of the cylinder body 358. A lightweight pneumatic cylinder can be purchased from Compair Watts Fluid Air, Inc., Cutts Road, Kittery, Me. (part no. 17DPRB5). In my present embodiment of the crimper assembly 300, this pneumatic cylinder has aluminum heads, a stainless steel body, 1.5 inch bore a five inch stroke. The cylinder body 358 has a threaded end which passes through a circular opening in a cylinder support bracket 360, and which is secured to the cylinder support bracket 360 with a nut 364. (See FIG. 2) The cylinder support bracket 360 is attached to the left end of the extension bracket 346 with three threaded bolts 361. The ram 359 is connected to a linear motion block 362. Two recessed allen bolts 363 fix both the linear motion block 362 and the front swivel bracket 349-*f* to the top of the front slide block 345-*f*. (See FIGS. 1, 3, 4 and 5**)

Figure 5:
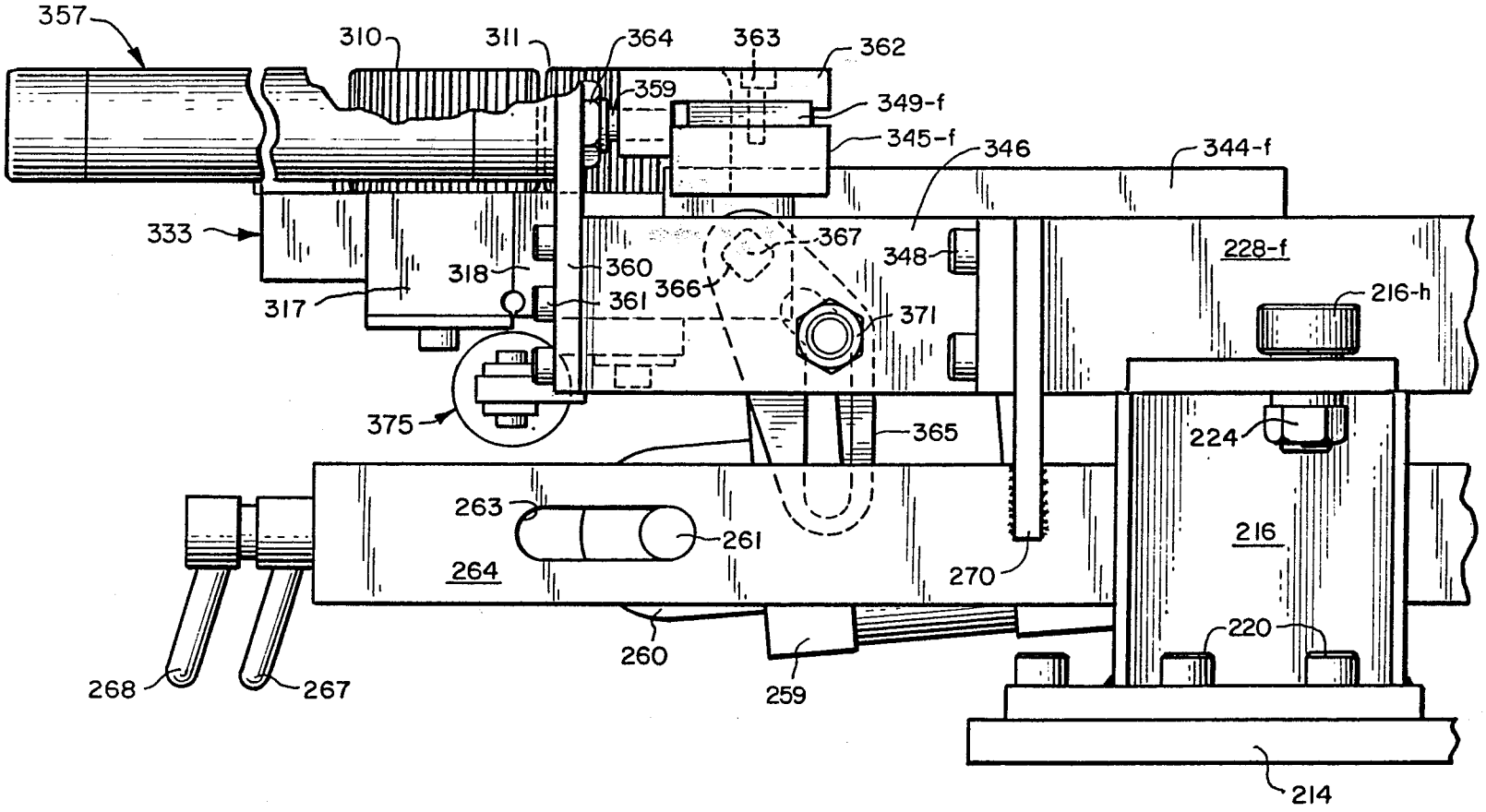
FIG. 5 is a side elevation view, partially in section, of the crimper assembly of the preferred embodiment of the present invention in its down position.
Figure 6:
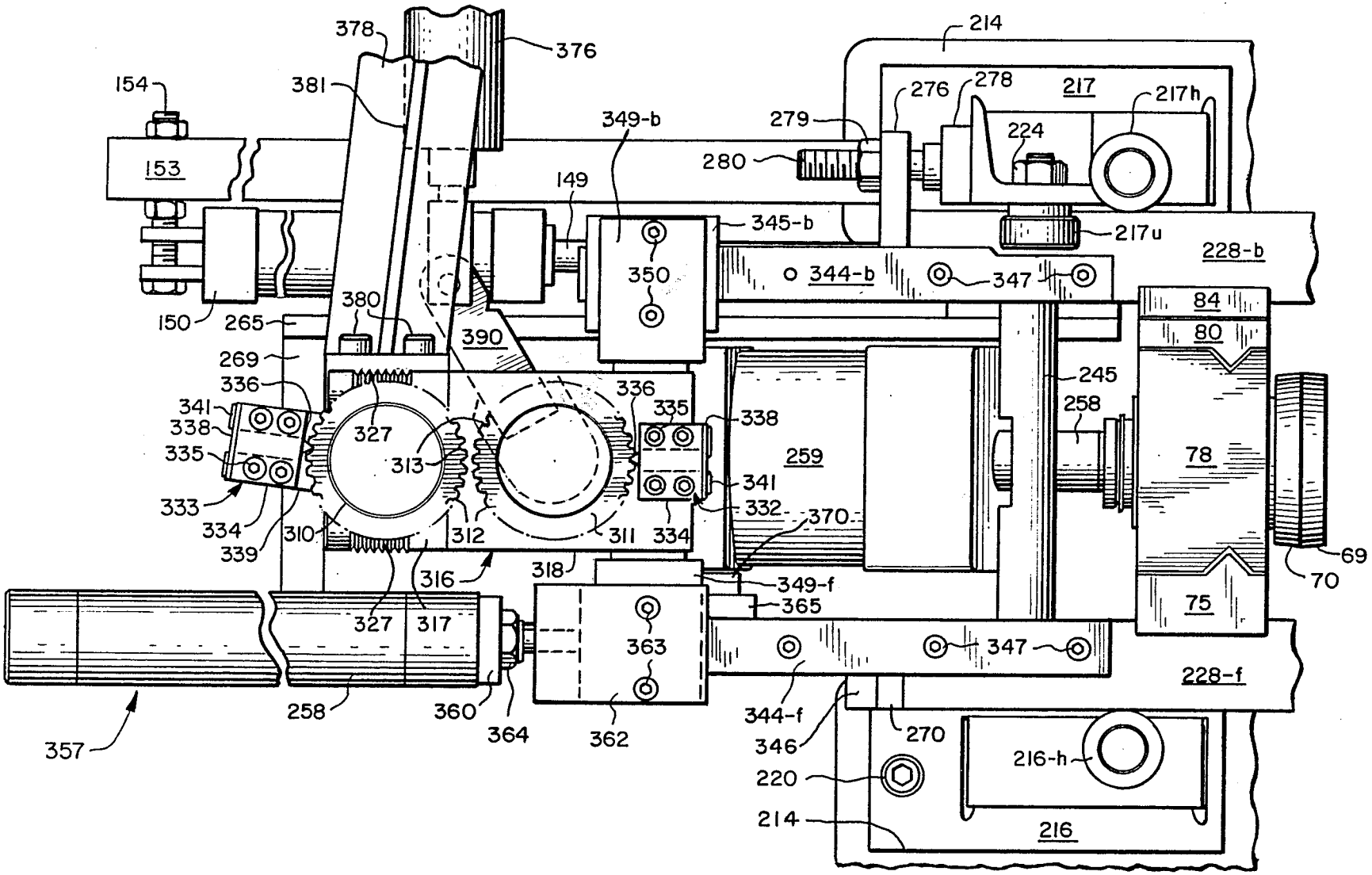
FIG. 6 is a plan view of the crimper assembly shown in FIG. 5.
Figure 7:
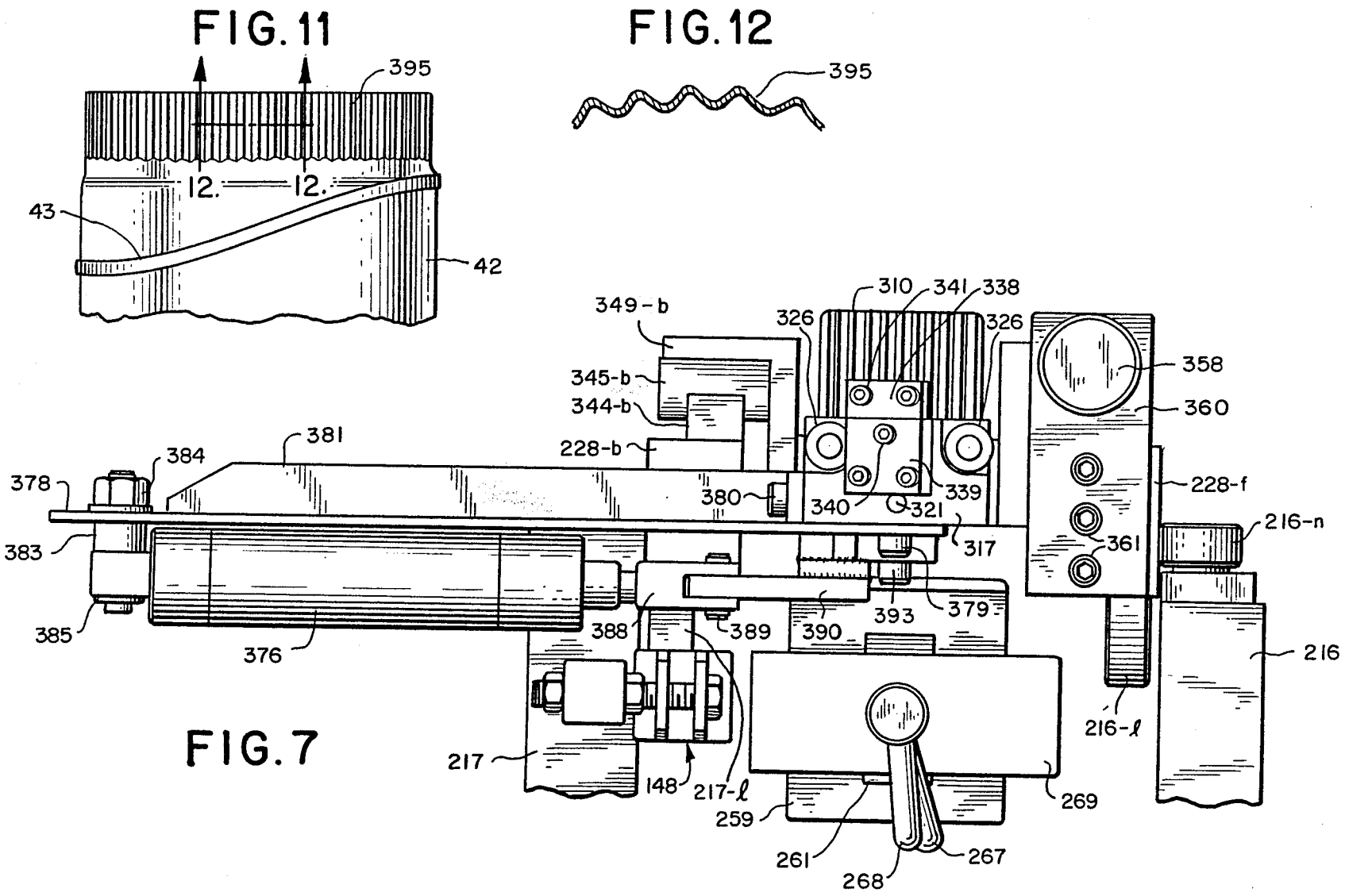
FIG. 7 is a left end elevation view of the crimper assembly shown FIGS. 5 and 6.

A dogleg-shaped link bracket 365 cooperates with several other parts to rotate the holder assembly 316 and rollers 310, 311 between their up position, shown in FIGS. 1–4, and their down position, shown in FIGS. 5–7. This link bracket 365 has a square opening 366 into which the square end 367 of the swivel shaft 351 tightly fits. Thus, the link bracket 365 should move linearly or rotate together with the square end 367 of the swivel shaft 351. (See FIGS. 2 and 5)

The link bracket 365 also has a dogleg-shaped slot 368 made up of a straight elongated part 368*a* and a short angled part 368*b* which meet at a bend 369. (See FIG. 2) A shoulder bolt 370 passes through the dogleg slot 368 and the extension bracket 346. (See FIGS. 3 and 4) The shoulder bolt 370 is fixed to the extension bracket 346 with a nut and washer 371. Needle bearings 372 are placed around the round shaft of the shoulder bolt 370 that extends through the link bracket 365. The head of the shoulder bolt 370 holds the needle bearings 372 against the extension bracket 346 to keep the needle bearings 372 in place in slot 368. The head of the shoulder bolt 370 has two opposed flat sides for gripping while securing nut 371.

The pneumatic cylinder assembly 357 cooperates with the link bracket 365, and several other parts, to move the holder assembly 316 and the crimping rollers 310, 311 between their up position, shown in FIGS. 1–4, and their down position, shown in FIGS. 5–7. FIG. 2, for example, shows the holder assembly 316 in the up position where the leading edge of the pipe 42 passes between the upper roller 310 and the lower roller 311. The ram 359 is fully extended. The shoulder bolt 370 is at the left end of the dogleg slot 368, thereby limiting further linear travel by the link bracket 365, and the rollers 310, 311 which are indirectly connected to it, toward the pipe 42. When the ram 359 begins to move linearly into the cylinder body 358, it will pull the linear motion bracket 362 towards the left end of the slide rails 345. The front swivel bracket 349-*f* and the front slide block 345-*f*, which are connected together with the linear motion block 362, will slide in the same direction along the front slide rail 344-*f*. (See FIG. 4) The front swivel bracket 349-*f* will pull the swivel shaft 351 with it. The swivel shaft 351 will in turn force the holder assembly 316, the link bracket 365, and the back swivel bracket 349-*b*, in the direction of the linearly moving ram 359. The rear swivel bracket 349-*b* will in turn slide with the back slide block 345-*b* along the rear slide rail 344-*b*.

Referring again to FIG. 2, it will be seen that when the square end 367 of the swivel shaft 351 moves the link bracket 365 to the left, the elongated part 368*a* of the dogleg slot 368 passes over the fixed shoulder bolt 370 and needle bearings 372. As long as the link bracket 365 is moving along its straight elongated part 368*a*, the crimping rollers 310, 311 will remain in the up position shown in FIG. 2. However, when shoulder bolt 370 engages the bend 369 in the dogleg slot 368, the continued linear movement of the ram 359 and the part of the link bracket connected to the square end 367 of the swivel shaft 351, will cause the link bracket 365 to rotate about the bend 369 and short angled portion 368*b* of slot 368, until the holder assembly 316 and rollers 310, 311 come to rest in the down position shown in FIGS. 5–7. The lower holder section 318 is indirectly fixed to the link bracket 365 via the swivel shaft 351, which causes the holder assembly 316 to rotate with the link bracket 365. The needle bearings 354 between the swivel shaft 352 and the lower opening of the swivel brackets 349 allow the entire holder assembly 316, including the crimping rollers, to be rotated up or down with the link bracket 365. (See FIG. 4) It should be understood that the rest or down position is determined by the shape of the slot 368. In the down position the continuously produced pipe 42 can move over or by the crimping assembly 300 freely, that is, without any interference or obstruction.

A second pneumatic cylinder assembly 375 is provided to lift the lower roller 311 towards or away from the upper roller 310. (See FIGS. 1, 3 and 4) This cylinder is similar to the first cylinder assembly 357, except that it has a 4 inch stroke. This pneumatic cylinder can also be purchased from Compair (part no. 17 DPRB 4). The cylinder body 376 is supported by a light, aluminum bracket 378, which is attached in cantilever fashion to the upper holder section 317. A first threaded bolt 379 fastens one face of the support bracket 378 to the back face of the upper section 317 and the upper roller shaft 320. This bolt 379 also helps to pull in the upper shaft 320, so that the upper roller 310 abuts the front face of the upper holder section 317. (See FIG. 2) A second pair of threaded bolts 380 attach another face of the support bracket 378 to a side face of the upper holder section 317. The support bracket 378 is provided with a stiffening rib 381 and an oval slot 382.

A pivot pin 383 connects the cylinder body 376 to the support bracket 378. (See FIGS. 3 and 4) This pivot pin 383 uses a washer 385 and pin 386 at one end to abut the cylinder body 376, and a nut and washer 384 at its opposite end to lock the pivot pin 383 in position in the oval slot 382 of the support bracket 378. The part of the pivot pin 383 that remains inside the oval slot 382 has straight edges adjacent to the slot edges. These straight edges prevent the pivot pin 383 from turning, which allows the nut 384 to be tightened to the threaded end of the pivot pin 383 with just one wrench.

A clevis 388 is attached to the end of the linearly actuable ram 377. (See FIGS. 3 and 4) One end of a lever 390 is connected to the clevis 388 with a pin 389. The opposite end of the lever 390 has a square opening which fits snugly over the square end 392 of the eccentric shaft 325 of the lower crimping roller 311. (See FIG. 4) A bolt and washer 393 are secured to the square end of the eccentric shaft 325 to keep the lever 390 on the square shaft end 392. Another washer 391 is provided between the lever 390 and the back face of the lower holder section 318. The lower roller shaft 325 has some axial play, so that the lever 390 does not get hung up on anything.

Linear movement of the ram 377 will rotate the lever 390, which turns the eccentric shaft 325. (See FIG. 4) Rotation of the eccentric shaft 325 will move the lower roller 311 towards or away from the upper roller 310. The lower roller 311 is raised towards the upper roller so that the teeth 312 of the two rollers cooperate to crimp the leading edge of the pipe 42, as shown in FIGS. 8 and 8*a*. The lower roller 311 is moved away from the upper roller 310 when the crimping rollers must be moved towards or away from the pipe 42.

It is preferred that the upper roller 310 is fixed at a position slightly above the inner pipe surface and the lower roller 311 is moved into crimping engagement with the pipe 42 and upper roller 310. In this manner the crimped leading edge 394 of the pipe is bent inwardly, so that its diameter is slightly reduced. This facilitates connection of the crimped end 395 with an uncrimped end of another section of pipe.

The oval slot 382 on the support bracket 378 provides a means for adjusting the depth of the crimp. The pivot pin 383 and nut and washer 384 allow the location of the cylinder body 376 to be varied along the slot 382. The position of the cylinder body 376 datermines the beginning and end points of the linear travel by the ram 377, which determines the minimum and maximum separation between the upper and lower rollers 310, 311 that the ram 377 will control. It should be apparent that the crimp will become shallower as the cylinder body 376 is moved to the left end of the slot 382 as shown in FIG. 4.

It should be noted that the lifting cylinder assembly 375 is attached to the upper holder section 317 in cantilever fashion, so that the lifting cylinder assembly 375, and attached parts, will move with the holder assembly 316 between its up position (see FIGS. 1–4) and its down position (see FIGS. 5–7). The lifting cylinder assembly 375 is specifically attached to the upper holder section 317, so that it will pivot with the upper section 317 when the pipe lockseam 43 rotates between the rollers. (See FIG. 8*b*) There is some play between the lever 390 and the clevis 388 which allows the lever 390 to twist with the cylinder assembly 375 components without a problem.

The operation of the crimping assembly 300 will now be described. This particular crimping assembly 300 is intended to operate in conjunction with the slitter assembly 200. A programmed sequence controller and a plurality of limit switches coordinate operation of the tube former, slitter and crimper apparatuses. The operation of the slitter assembly 200 will be briefly summarized. A detailed description of the slitter assembly 200 can be found in my U.S. patent application Ser. No. 746,237, the parent application of application Ser. No. 876,286. These applications are again incorporated by reference herein and made a part hereof.

The metal strip 15 that is formed into spiral seamed pipe 42 moves spirally out of the forming head 21 as it is continuously produced. When the leading edge of the pipe hits a first switch, the moving pipe slows down. The master controller quickly stops further pipe production. The toggle link cylinder assembly 250 then extends its ram 258, which raises the lower slitter knife 70 so that it punctures the pipe 42 and overlaps with the upper slitter knife 69. After a 1–2 second delay, the pipe 42 starts moving spirally (i.e., being produced) again at a slow speed, and the ram 149 of the friction compensating cylinder assembly 148 pulls into its cylinder body 150. The pipe 42 will then rotate between the overlapping slitter blades 69, 70, so that they cooperate to cut the pipe. The linear guide beams 228, which carry the slitter blades, slide in the axial direction of the pipe in response to the force exerted on the slitter blades by the moving pipe and the assist provided by the friction compensating cylinder assembly 148. By moving with the guide beams 228 in the pipe's axial direction, the slitter blades will cut the pipe rectangularly as the pipe rotates between the blades and moves forward.

The components of slitter assembly 200 carried by the guide beams 228 move axially with the moving pipe 42 until a component of the moving slitter assembly hits a second switch. The second switch is placed at a position at which any diameter pipe will have completed one rotation, so that the entire circumference of the pipe will be cut. The pipe then stops moving again, and the toggle cylinder ram 258 pulls into the cylinder body 259 to lower the lower slitter blade 70. After a short time delay the friction compensating cylinder ram 149 reverses direction, and returns the slitter blades 69, 70 to their starting position. A discharge mechanism is then raised to move the cut pipe section to a run-off table. A third switch is closed when the discharge mechanism is lowered to its start position, after a brief delay.

The crimping process may begin after the third switch is closed. This will assure that the crimping assembly 300 will not collide with the cut pipe section, since it has been discharged to a run-off table.

An on/off CRIMP actuation switch also should be added to the control panel 13 of the tube forming machine 10. When the CRIMP switch is off, the crimping assembly would remain in its down position (see FIGS. 5–7) and not interfere with the normal pipe forming and slitting processes. The crimping assembly 300 would be deactivated when pipes that do not require crimping are produced. Thus, when the third switch is closed, indicating that the discharge mechanism has been lowered, the pipe forming machine 10 could begin again automatically at high speed. Alternatively, the crimping assembly 300 could be operated manually when the CRIMP switch is off. Manual operation could proceed in a similar manner to the automatic operation to be described now.

When the CRIMP switch is on, the crimping assembly will be in its down position (see FIGS. 5–7) until the third switch closes, indicating that the discharge mechanism has returned to its down position. After a short delay the ram 359 of the linear motion cylinder assembly 357 will move towards its fully extended position. This ram will slide the linear motion block 362, the swivel brackets 349, the swivel shaft 351, the holder assembly 316, the link bracket 365, and any other parts attached to these components, as a single unit along the slide rails 344. Referring now to FIG. 5, it will be seen that as the square end 367 of the swivel shaft 351 pushes the upper part of the link bracket 365 to the right, the dogleg slot 368 will cause the link bracket 365 to rotate around the shoulder bolt 370. Since the holder assembly 316 is connected to the upper part of the link bracket 365 via the swivel shaft 351, the holder assembly and rollers 310, 311 will rotate upwardly with the link bracket 365. Continued linear travel by the ram 359 will continue to rotate the link bracket 365 and holder assembly 316 until they reach their upright position. Further linear movement by the ram 359 will cause the link bracket 365 to slide forward along the elongated part 368*a* of its slot 368. As the link bracket 365 slides along its straight portion 368*a*, the shoulder bolt 370 maintains the holder assembly 316 in its up position as it, and the parts connected to it, slide along the slide rails 344. The holder assembly 316 will continue to slide along the slide rails 344 in the up position until the dogleg slot 368 engages the shoulder bolt 370 as shown in FIG. 2. This will be referred to as the crimping start position. It is preferred that the ram's 359 end of travel coincides with the crimping start position.

Figure 3:
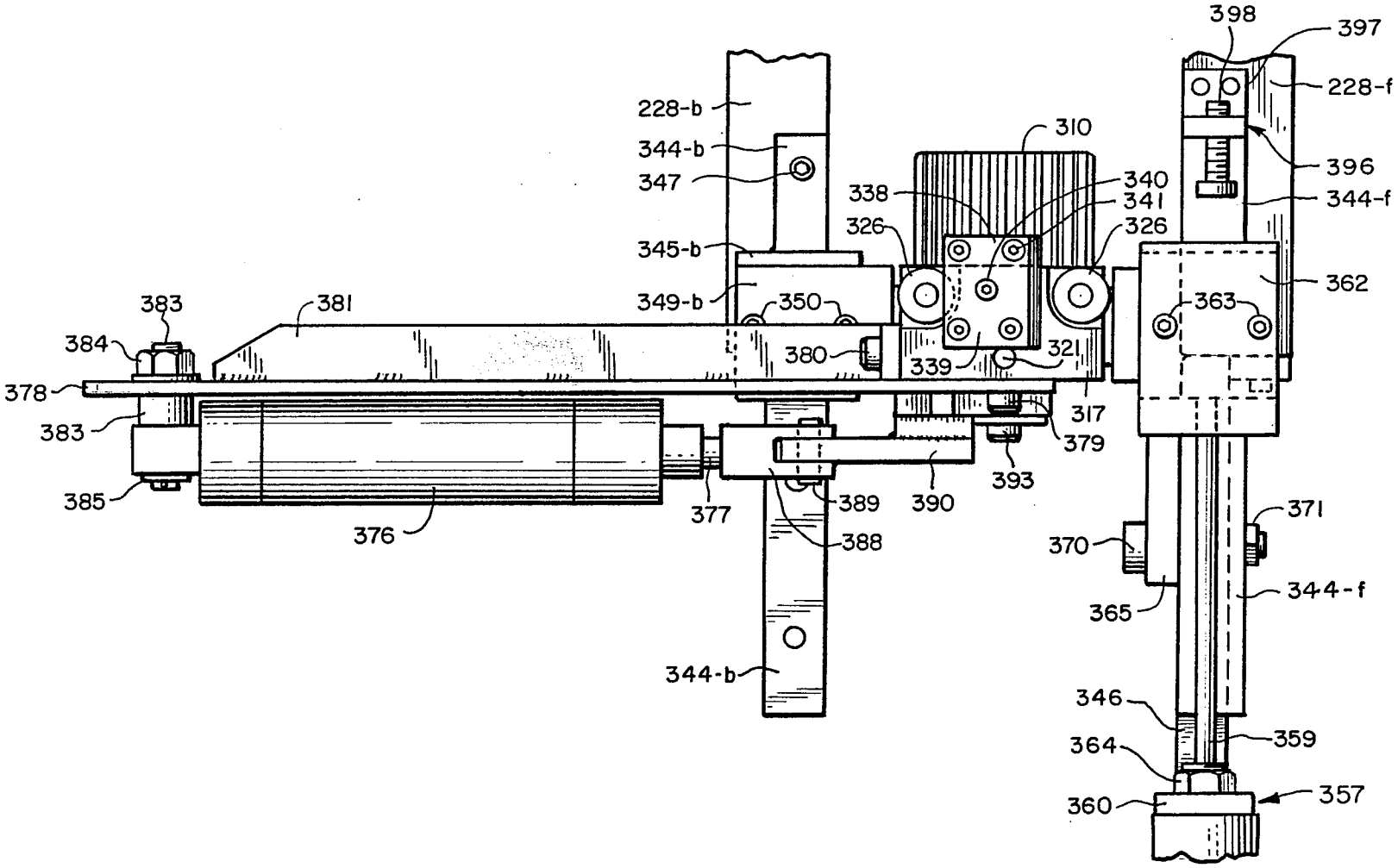
FIG. 3 is a plan view taken along lines 3—3 of FIG. 2.

An adjustable stop 396 can be provided to adjust the crimping start position. This stop 396 can be similar in construction to the stop mechanism 276 provided for in the slitter assembly 200. For example, FIG. 3 shows a stop 396 having an L-shaped plate 397 fixed to the front slide rail 344-*f* or front guide beam 228-*f*. A bolt 398 is threaded into the plate 397. The padded head of the bolt 398 will stop linear movement of the linear motion block 362. Thus, turning the bolt 398 will adjust the crimping start position.

When the holder assembly 316 reaches the crimping start position, the leading edge of the pipe 42 should pass between the separated upper and lower crimping rollers 310, 311, since the lower roller 311 is maintained in its lowered position when not crimping. The dogleg slot 368 is designed to effect rotation of the holder assembly 316 between the down and up positions away from the pipe, so that holder assembly 316 and rollers 310, 311 will be clear of the pipe 42 as they rotate up and down. (Note that part of spacer rod 245 of the slitter assembly 200 has been cut out to provide clearance for the lower index unit 332 as it moves between the up and down positions.) Sliding the rollers 310, 311 in their upright position for a linear distance helps insure that the leading edge of the pipe will slip between the rollers 310, 311 without problems.

When the holder assembly 316 reaches the crimping start position, the lifting ram 377 is actuated to extend to its end of travel. (See FIG. 4) The linear motion of the lifting ram 377 turns the lever 390, which rotates the eccentric shaft 325 to raise the lower roller 311. When fully raised, the teeth 312 of the lower and upper crimping rollers should crimp the leading edge of the pipe. The crimping assembly 300 is presently designed to provide a 1.5 inch long crimp. The length of the crimp can be varied by the adjustable stop bracket 396.

After a 1-2 second delay, the pipe 42 starts moving spirally again at slow speed, and the ram 149 of the friction compensating cylinder assembly 148 pulls into its cylinder body 150. The 42 pipe will then rotate between the upper and lower crimping rollers 310, 311, so that they cooperate to crimp the leading edge of the pipe. The linear guide beams 228 of the slitter assembly 200, which also carry the crimping assembly 300, allow the entire crimper assembly to be moved in the axial direction of the pipe by the force exerted on the crimper rollers 310, 311 by the moving pipe and the assist provided by the friction compensating cylinder assembly 148. By moving with the pipe in its axial direction, the rollers 310, 311 will crimp the leading edge of the pipe rectangularly as the pipe rotates between the crimping rollers and moves forward. A rectangularly crimped leading pipe edge 395 is shown in FIGS. 1, 11 and 12. By "rectangular," I mean that the crimp follows a circular path which is perpendicular to the pipe axis, as opposed to a helical path. The pipe lockseam 43 will pass between the crimping rollers in the manner shown in FIG. 8*b* and described above.

The crimper assembly 300 moves axially with the moving pipe 42 until a slitter component moving with the linear guide beams 228 hit the second switch, which is placed at the position at which any diameter pipe will have completed one rotation. This assures that the entire circumference of the leading edge of the pipe will be crimped. The pipe then stops moving again, and the lifting ram 377 moves linearly back into the cylinder body 376 to lower the lower crimping roller 311.

After a short time delay the friction compensating cylinder ram 149 and the linear motion ram 359 reverse directions. The friction compensating ram 149 returns the linear guide beams 228, with the slitter assembly 200 and crimper assembly 300 attached thereto, to their starting position. The linear motion ram 359 returns the holder assembly 316 and crimping rollers 310, 311 to their down position, as shown in FIG. 5. When the ram 359 begins to withdraw into the cylinder body 376, the holder assembly 316 will remain in its upright position as the oval part of the dogleg slot 368 of the link bracket 365 travels past the shoulder bolt 370. When the bend 369 in the slot 368 engages the shoulder bolt 370, further linear movement by the ram 377 causes the link bracket 365 and holder assembly 316 to rotate downwardly until they reach their rest position shown in FIG. 5.

When the crimper assembly 300 reaches its rest position, it activates a fourth switch. The fourth switch is connected in series with the third switch, which is closed by lowering the discharge device. Thus, only when both the third and fourth switches are closed, thereby indicating that both the discharge mechanism and crimping apparatus are in the down positions, will the pipe forming process begin again at high speed.

It should be recognized that when the leading edge of the first pipe section is to be formed, the pipe production can be manually stopped when the leading edge is at the crimping start position. The crimper assembly 300 can then be manually operated to crimp the leading edge of the pipe. Thereafter, the pipe production, pipe slitting, and crimping operations can be carried out automatically.

It should now be apparent that an important advantage of this invention is that it provides a means for automatically crimping the leading edge of continuously formed spiral pipe. The invention thereby avoids the additional labor required when pipe sections must be carried from the pipe production machine to a separate, stand-alone crimping machine. The crimping apparatus of the present invention also crimps the leading edge of pipe sections of any length with the same facility, since the leading edge is crimped before the pipe is formed to its desired length.

It should be understood that various changes and modifications to the preferred embodiment described above will be apparent to those skilled in the art. For example, the crimper assembly 300 is not limited in application to use with the slitter assembly 200 illustrated in the drawings. The present invention may be adapted for use with any machine that produces hollow pipe on a production basis. The present invention is particularly well-suited, however, for use with any type of machine for continuously producing spiral pipe. Spirally formed pipe is generally more difficult to crimp while the pipe is being formed, inasmuch as the pipe moves forward while rotating during production.

It should also be understood that various elements of the crimper assembly described above can be changed or modified within the spirit of this invention. For example, various types of common delay circuits could be used in place of some of the limit switches for controlling the automatic operation of the crimping apparatus.

It is intended that the foregoing description be regarded as illustrative rather than limiting, and that it be understood that it is the following claims, including all equivalents, which are intended to define the scope of the invention.

I claim:

1. For use with a machine for continuously producing spiral seamed pipe from a metal strip including drive means for continuously feeding the strip through the machine, means for forming the strip into a spiral cylinder so that the outer edges of the strip are adjacent each other, means for joining the adjacent edges to produce a pipe having a spiral lockseam, and the leading edge of the continuously produced pipe moving in an axial direction as it rotates, an apparatus for crimping the leading edge of the pipe comprising:

means for holding a plurality of rollers;

first and second rollers rotatably mounted in the holding means adjacent each other, each roller having a corrugated circumferential edge;

guide means for carrying the holding means and being slidable in the axial direction of the pipe;

means for moving the holding means between a first position where the continuously produced pipe can move freely by the holding means and rollers, and a second position where the leading edge of the pipe will pass between the corrugated edges of the first and second rollers; and means for lifting the first roller towards the second roller when the holding means is in the second position and the leading edge of the pipe is between the rollers, so that the corrugated edges of the rollers cooperate to crimp the pipe's leading edge, and whereby the moving pipe exerts a force on the rollers and holding means which causes the guide means to slide in the axial direction of the pipe, and the pipe's leading edge rotates between the first and second rollers as it moves axially so that the rollers can crimp the circumference of the leading edge.

2. The invention of claim 1 wherein the holding means includes a first section and a second section and the first roller is rotatably mounted in the first section and the second roller is rotatably mounted in the second section, the second section being connected to the first section so that when the lockseam of the pipe rotates between the first and second rollers, the second roller will move away from the first roller and the rollers can still crimp part of the pipe's leading edge adjacent the lockseam.

3. The invention of claim 1 further comprising means for indexing the corrugated edge of the first roller relative to the corrugated edge of the second roller so that the corrugated edges of the first and second rollers overlap.

4. The invention of 3 wherein each roller includes a plurality of evenly spaced teeth on its circumferential edge which forms the corrugated edge, and the indexing means offsets the teeth of the first roller one-half tooth with respect to the teeth of the second roller.

5. The invention of claim 1 wherein the first roller is mounted on an eccentric shaft, and rotation of the eccentric shaft moves the first roller towards or away from the second roller, and the lifting means includes a lever connected at a first end to the eccentric shaft and at a second end to a linearly actuable ram, wherein linear movement of the ram rotates the lever and eccentric shaft.

6. The invention of claim 5 wherein the ram is connected to the holding means so that the ram and lever move with the holding means between the first and second positions.

7. For use with a machine for continuously producing spiral seamed pipe from a metal strip including drive means for continuously feeding the strip through the machine, means for forming the strip into a spiral cylinder so that the outer edges of the strip are adjacent each other, means for joining the adjacent edges to produce a pipe having a spiral lockseam, and the leading edge of the continuously produced pipe moving in an axial direction as it rotates, an apparatus for crimping the leading edge of the pipe comprising:

means for holding a plurality of rollers;

first and second passive rollers rotatably mounted in the holding means adjacent each other, each roller having a corrugated circumferential edge;

guide means for carrying the holding means and being slidable in the axial direction of the pipe;

means for moving the holding means between a first position where the continuously produced pipe can move freely by the holding means and rollers, and a second position where the leading edge of the pipe will pass between the corrugated edges of the first and second rollers;

the moving means including a bracket connected to the holding means and a linearly actuable ram connected to the holding means, the bracket allowing the holding means and rollers to slide along the guide means in the second position for a first linear distance traveled by the ram, and causing the holding means and rollers to move between the first position and the second position for a second linear distance traveled by the ram; and means for lifting the first roller towards the second roller when the holding means is in the second position and the leading edge of the pipe is between the rollers, so that the corrugated edges of the rollers cooperate to crimp the pipe's leading edge, and whereby the moving pipe exerts a force on the rollers and holding means which causes the guide means to slide in the axial direction of the pipe, and the pipe's leading edge rotates between the first and second rollers as it moves axially so that the rollers can crimp the circumference of the leading edge.

8. The invention of claim 7 wherein the guide means includes first rail means which slide in the axial direction of the pipe under the force of the moving pipe, and second rail means fixed to the first rail means and carrying the holding means and rollers, whereby the bracket allows the holding means and rollers to slide in the second position along the second rail means for the first linear distance traveled by the ram.

9. For use with a machine for continuously producing spiral seamed pipe from a metal strip including drive means for continuously feeding the strip through the machine, means for forming the strip into a spiral cylinder so that the outer edges of the strip are adjacent each other, means for joining the adjacent edges to produce a pipe having a spiral lockseam, and the leading edge of the continuously produced pipe moving in an axial direction as it rotates, an apparatus for crimping the leading edge of the pipe comprising:

first and second passive rollers each having a plurality of teeth evenly spaced around its circumference;

a roller holder means having first and second sections, the first roller being rotatably mounted on an eccentric shaft in the first section, the second roller being rotatably mounted in the second section and positioned adjacent the first roller, and the second section being pivotally connected to the first section;

guide means for carrying the holder means and being slidable in the axial direction of the pipe;

means for moving the holding means between a down position where the continuously produced pipe can move freely over the holder means and rollers, and an up position where the leading edge of the pipe will pass between the teeth of the first and second rollers;

the moving means including a bracket connected to the holder means and a first linearly actuable ram connected to the holder means, the bracket allowing the holder means and rollers to slide in the up position along the guide means for a first linear distance traveled by the first ram, and causing the holder means and rollers to rotate between the up and down positions for a second linear distance traveled by the first ram; and means for lifting the first roller towards the second roller when the holder means is in the up position and the leading edge of the pipe is between the rollers, so that the teeth of the rollers cooperate to crimp the pipe's leading edge, and whereby the guide means, holder means and rollers will slide in the axial direction of the moving pipe, and the roller teeth will crimp the circumference of the pipe's leading edge as it rotates between the rollers, and the second roller will pivot away from first roller as the pipe's lockseam rotates between the rollers so that the rollers can still crimp part of the pipe's leading edge adjacent the lockseam.

10. The invention of claim 9 wherein the guide means includes first rail means which slide in the axial direction of the moving pipe, and second rail means fixed to the first rail means and carrying the holder means and rollers, whereby the bracket allows the holder means and rollers to slide in the up position along the second rail means for the first linear distance traveled by the first ram.

11. The invention of claim 9 wherein the lifting means includes a lever connected at a first end to the eccentric shaft of the first roller and at a second end to a second linearly actuable ram, wherein linear movement by the second ram rotates the lever and eccentric shaft to move the first roller towards or away from the second roller.

12. The invention of claim 11 wherein the ram is cantilevered to the second section of the holder means so that the ram and lever move with the holder means between the up and down positions.

13. The invention of claim 9 further comprising means for indexing the teeth of the first and second rollers to be offset one-half tooth with respect to each other.

14. An apparatus for crimping the leading edge of continuously produced pipe, where the pipe rotates and moves forward in an axial direction during production, comprising:

first and second rollers each having a corrugated circumferential edge;

holder means in which the first and second rollers are rotatably mounted adjacent each other;

guide means for carrying the holder means and being slidable in the axial direction of the pipe;

means for moving the holder means between a first position where the continuously produced pipe can move freely by the holder means and rollers, and a second position where the leading edge of the pipe will pass between the corrugated edges of the first and second rollers; and means for lifting the first roller towards the second roller when the holder means is in the second position and the leading edge of the pipe is between the rollers, so that the corrugated edges of the rollers cooperate to crimp the pipe's leading edge, and whereby the guide means, holder means and rollers will slide in the axial direction of the pipe as it moves forward, and the corrugated edges of the rollers will crimp the circumference of the pipe's leading edge as it rotates between the rollers.

15. An apparatus for crimping the leading edge of continuously produced pipe, where the pipe rotates and moves forward in an axial direction during production, comprising:

first and second passive rollers each having a corrugated circumferential edge;

holder means in which the first and second rollers are rotatably mounted adjacent each other;

guide means for carrying the holder means and being slidable in the axial direction of the pipe;

means for moving the holder means between a first position where the continuously produced pipe can move freely by the holder means and rollers, and a second position where the leading edge of the pipe will pass between the corrugated edges of the first and second rollers;

the moving means including a bracket connected to the holder means and a linearly actuable ram connected to the holder means, the bracket allowing the holder means and rollers to slide in the second position along the guide means for a first linear distance traveled by the ram, and causing the holder means and rollers to move between the first position and the second position for a second linear distance traveled by the ram; and means for lifting the first roller towards the second roller when the holder means is in the second position and the leading edge of the pipe is between the rollers, so that the corrugated edges of the rollers cooperate to crimp the pipe's leading edge, and whereby the corrugated edges of the rollers will crimp the circumference of the pipe's leading edge as it rotates between the rollers, and the guide means, holder means and rollers will slide in the axial direction of the pipe as it moves forward.

16. An apparatus for crimping the leading edge of continuously produced pipe, where the pipe rotates and moves forward in an axial direction during production, and the pipe having a lockseam, comprising:

first and second passive rollers each having a plurality of teeth evenly spaced around its circumference;

a roller holder means having first and second sections, the first roller being rotatably mounted on an eccentric shaft in the first section and the second roller being rotatably mounted in the second section and positioned adjacent the first roller, and the second section being pivotally connected to the first section;

guide means for carrying the holder means and being slidable in the axial direction of the pipe;

means for moving the holder means between a down position where the continuously produced pipe can move freely over the holder means and rollers, and an up position where the leading edge of the pipe will pass between the teeth of the first and second rollers;

the moving means including a bracket connected to the holder means and a first linearly actuable ram connected to the holder means, the bracket allowing the holder means and rollers to slide in the up position along the guide means for a first linear distance traveled by the first ram, and causing the holder means and rollers to rotate between the up and down positions for a second linear distance traveled by the first ram; and means for lifting the first roller towards the second roller when the holder means is in the up position and the leading edge of the pipe is between the rollers, so that the teeth of the rollers cooperate to crimp the pipe's leading edge, and whereby the teeth of the rollers will crimp the circumference of the pipe's leading edge as it rotates between the rollers, and the guide means, holder means and rollers will slide in the axial direction of the pipe as it moves forward, and the second roller can pivot away from the first roller as the pipe lockseam rotates between the rollers so that the roller teeth will crimp part of the pipe's leading edge adjacent the lockseam.

17. The invention of claim 16 wherein the guide means includes first rail means which slide in the axial direction of the pipe and second rail means fixed to the first rail means and carrying the holder means and rollers, whereby the bracket allows the holder means and rollers to slide in the up position along the second rail means for the first linear distance traveled by the first ram.

18. The invention of claim 16 wherein the lifting means includes a lever connected at a first end to the eccentric shaft of the first roller and at a second end to a second linearly actuable ram, wherein linear movement by the second ram rotates the lever and eccentric shaft to move the first roller towards or away from the second roller.

19. The invention of claim 18 wherein the second ram is cantilevered to the second section of the holder means so that the ram and lever move with the holder means between the up and down positions.

20. The invention of claim 16 further comprising means for indexing the teeth of the first and second rollers to be offset one-half tooth with respect to each other.

* * * * *

UNITED STATES PATENT AND TRADEMARK OFFICE

CERTIFICATE OF CORRECTION

PATENT NO. : 4,711,110

DATED : December 8, 1987

INVENTOR(S) : Wilhelmus P.H. Castricum

It is certified that error appears in the above-identified patent and that said Letters Patent is hereby corrected as shown below:

IN THE BACKGROUND OF THE INVENTION

In column 1, line 38, please delete "June 15" and substitute therefor --June 17--.

IN THE BRIEF DESCRIPTION OF THE DRAWINGS

In column 3, line 42, please delete "in position" and substitute therefor --in its up position--;

In column 3, line 61, after the word "shown" and before "FIGS.", please insert the word --in--.

IN THE DETAILED DESCRIPTION
OF A PREFERRED EMBODIMENT

In column 4, line 35, after "FIGS. 1-3" and before the closing parenthesis, please insert --and pages 5-8--;

In column 8, line 48, after the word "bore" and before "a", please insert the word --and--;

In column 10, line 65, please delete "datermines" and substitute therefor --determines--.

UNITED STATES PATENT AND TRADEMARK OFFICE

CERTIFICATE OF CORRECTION

PATENT NO. : 4,711,110

DATED : December 8, 1987

INVENTOR(S) : Wilhelmus P.H. Castricum

It is certified that error appears in the above-identified patent and that said Letters Patent is hereby corrected as shown below:

IN THE CLAIMS

In Claim 4 (column 15, line 30), please delete "of 3" and substitute therefor --of Claim 3--;

In Claim 9 (column 17, line 7), please delete "from first" and substitute therefor --from the first--.

Signed and Sealed this

Twenty-ninth Day of November, 1988

*Attest:*

DONALD J. QUIGG

*Attesting Officer*

*Commissioner of Patents and Trademarks*